United States Patent [19]

Ratalahti

[11] Patent Number: 5,026,121

[45] Date of Patent: Jun. 25, 1991

[54] MODULAR FURNITURE ASSEMBLY AND KIT THEREFOR

[76] Inventor: Matti Ratalahti, Paimenpolku 8, 15900 Lahti 90, Finland

[21] Appl. No.: 551,437

[22] Filed: Jul. 10, 1990

[51] Int. Cl.[5] ..... A47C 3/00

[52] U.S. Cl. ..... 297/440; 297/443

[58] Field of Search ..... 297/440, 443, 444, 445, 297/450; 108/56.1, 56.3; 403/354, 373, 375, 391

[56] References Cited

U.S. PATENT DOCUMENTS

| | | | |
|---|---|---|---|
| 1,392,242 | 9/1921 | Albergoli | 297/445 |
| 1,650,697 | 11/1927 | De Frehn | 297/445 |
| 2,703,136 | 3/1955 | Masse | 297/440 |
| 2,770,983 | 11/1956 | Hatala | 403/375 |
| 2,821,762 | 2/1958 | Foose | 403/391 |
| 4,103,969 | 8/1978 | Glessner | 297/440 |
| 4,619,545 | 10/1986 | Küttenbaum | 403/373 |

FOREIGN PATENT DOCUMENTS

| | | | |
|---|---|---|---|
| 294556 | 1/1916 | Fed. Rep. of Germany | 108/153 |
| 478319 | 2/1951 | Italy | 108/155 |

*Primary Examiner*—Peter R. Brown
*Assistant Examiner*—Milton Nelson, Jr.
*Attorney, Agent, or Firm*—Phillips, Moore, Lempio & Finley

[57] ABSTRACT

A modular furniture assembly comprises a plurality of structural members, such as a seat, backrest and legs of a chair, adapted to be releasably secured together. In the herein described chair embodiment, the upper end of each leg is secured to an underside of the seat by a clamping arrangement. Each clamping arrangement comprises a pair of clamping members defined by a slot formed in the seat and a fastener disposed transversely relative to the slot for drawing the clamping members together to releasably secure the leg to the seat. A similar arrangement is described for releasably attaching structural members of a bookcase or the like together.

8 Claims, 3 Drawing Sheets

MODULAR FURNITURE ASSEMBLY AND KIT THEREFOR

TECHNICAL FIELD

This invention relates generally to a modular furniture assembly and, more particularly, to a clamping arrangement for releasably securing component parts of the furniture assembly together.

BACKGROUND OF THE INVENTION

Conventional chairs comprise a horizontally disposed seat having a plurality of legs secured thereunder and a backrest secured rearwardly on the seat in upstanding relationship thereon. The component parts of the seat are normally secured together by fasteners, adhesives and the like to unitize the chair in a manufacturing facility prior to shipping. The shipping and related costs add substantially to the retail price of the chair, particularly when the chair is shipped a long distance, such as chairs that are imported.

Various techniques have been used to form a modular furniture construction to alleviate the above problems and to also reduce manufacturing costs. For example, it has been common practice to ship component parts of a knocked-down furniture assembly, such as a chair or bookcase, along with fasteners used for assembly purposes. The component parts are adapted to be attached together by screws, bolts or other standard types of fasteners whereby the end user is enabled to assemble and unitize the chair at home. Furniture assemblies of this type are oftentimes cumbersome to assemble, expensive to manufacture and do not always provide the desired structural integrity at the integrated joints thereof.

SUMMARY OF THE INVENTION

An object of this invention is to provide an economical and non-complex modular furniture assembly adapted to be shipped in kit form and expeditiously assembled by an end user to exhibit a high degree of structural integrity.

The modular furniture assembly comprises at least two members adapted to be releasably attached together. A slot is formed in the first member, such as a chair seat or shelf, to define and separate a pair of integral clamping members. At least one receptacle is also formed in the first member to bridge the slot. A second member, such as a leg, is inserted and closely fitted within the receptacle. A fastener, disposed transversely relative to the slot, is installed in the first member to draw the clamping members together to releasably secure the first and second members together.

In another aspect of this invention, the furniture assembly may assume a kit form to provide a plurality of furniture components adapted to be secured together by releasable fasteners of the type described above.

This invention can be used for chairs, couches, tables, footstools, bookcases and other types of furniture assemblies, as will be appreciated by those skilled in the furniture arts.

BRIEF DESCRIPTION OF THE DRAWINGS

Other objects and advantages of this invention will become apparent from the following description and accompanying drawings wherein.

DETAILED DESCRIPTION

Figure 1:
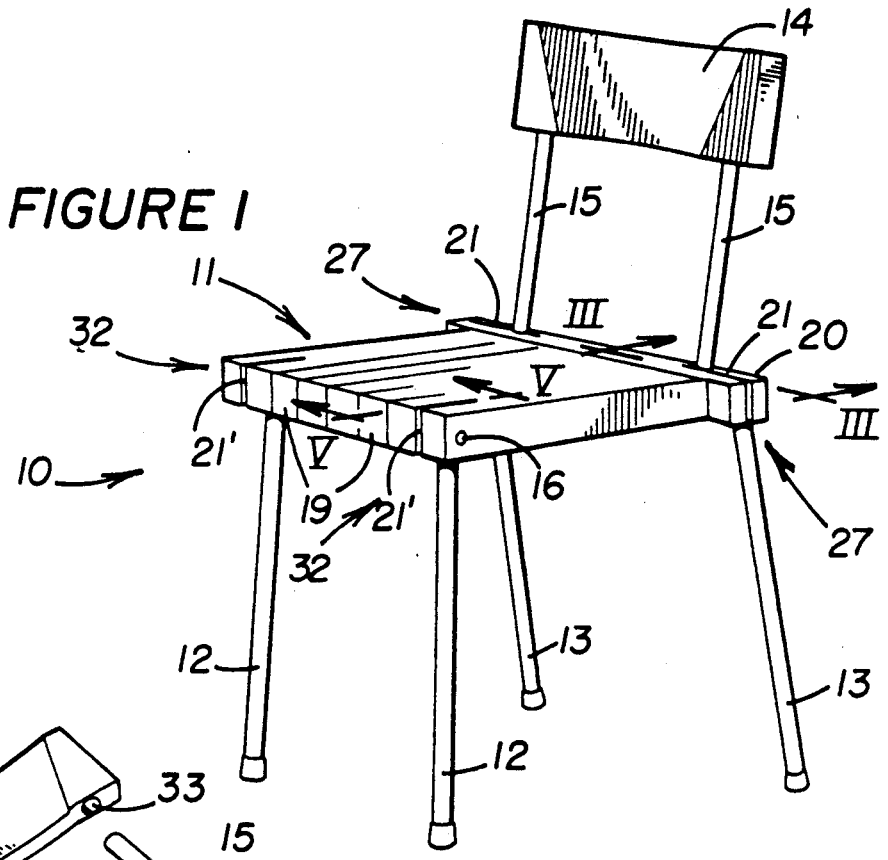
FIG. 1 is a frontal perspective view of a chair embodying this invention.

FIG. 1 illustrates a modular furniture assembly in the form of a chair 10 having a horizontally disposed and rectangular seat 11 supported on a pair of front legs 12 and a pair of rear legs 13. An upright backrest 14 is secured rearwardly on seat 11 by a pair of laterally spaced backrest support members 15. Although the modular furniture assembly invention is herein described with specific application to chair 10, it should be understood that the invention can be used for other furniture assemblies, such as sofas, tables, footstools, bookcases and the like.

Figure 2:
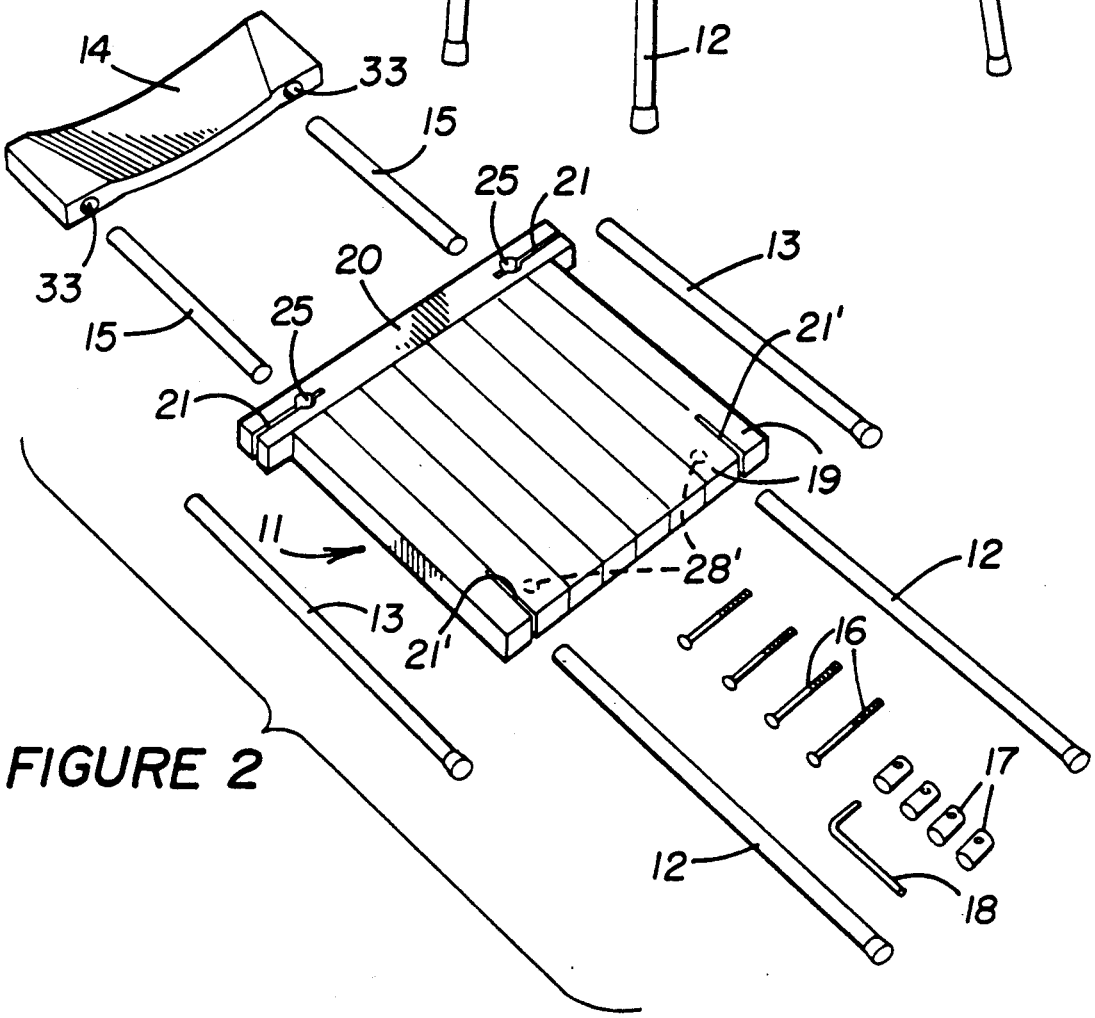
FIG. 2 illustrates knocked-down component parts of the chair in disassembled or kit form.

FIG. 2 illustrates chair 10 in its knocked-down or kit form for shipping purposes. It can be seen that the component parts of the modular chair, further including a plurality of bolts 16 and nuts 17, are adapted to be compactly packaged for such purpose. An Allen wrench 18, having a standard hex-shaped tip, may be included in the packaged furniture assembly to engage a like-formed hex socket formed in the head of each fastener 16 during assembly, as described more fully hereinafter. As shown in FIG. 1, the configuration of the assembled chair is such that it enables a plurality of chairs to be stacked on each other for space-saving purposes.

Seat 11 comprises a plurality of wooden seating members 19, each having a rectangular cross-section and secured together in side-side relationship by a suitable bonding adhesive. Each member 19 is disposed to have its grain run in a longitudinal direction between the frontal and rearward sides of the seat. A similarly configured single wooden cross-member 20 is secured to the ends of members 19 at the rearward side of the seat, also by a suitable adhesive. The grain of the cross-member extends transversely across the seat and the grains of members 19, between opposite, lateral sides of the seat. As shown in FIG. 1, the opposite ends of member 20 preferably extend beyond members 19.

The seating members and cross-member, as well as backrest 14, may be composed of a suitable wooden material, such as oak, birch, pine, mahogany or the like. Alternatively, members 29 and 20 and backrest 14 could be composed of a suitably molded plastic (e.g., fiberglass reinforced pultrusion or FRP), metal or other suitable structural material well-known for use in furniture constructions.

Figure 3:
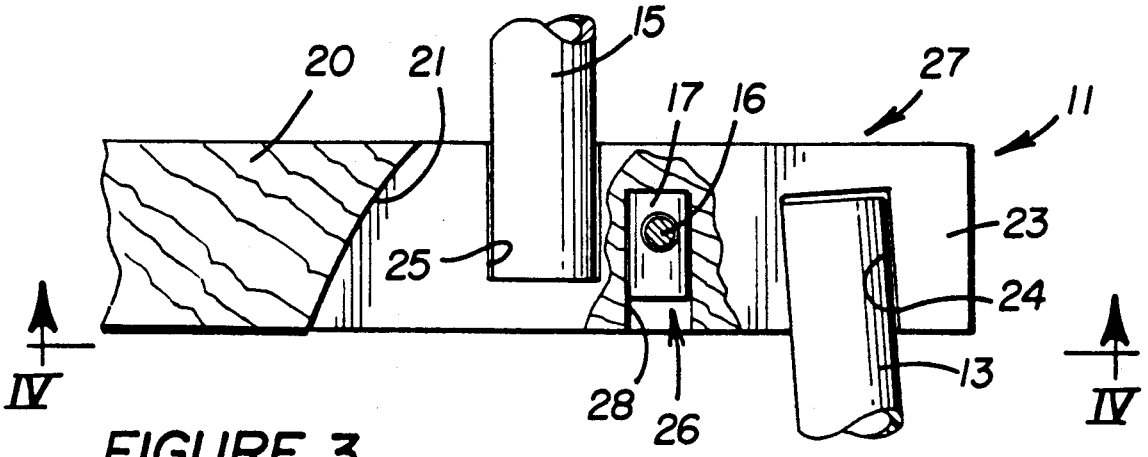
FIG. 3 is an enlarged sectional view, taken in the direction of arrows III—III in FIG. 1, illustrating a typical clamping arrangement for securing the upper end of a rear leg of the chair to a seat thereof with the view being further sectioned to illustrate the relative position of a bolt and nut fastener.
Figure 4:
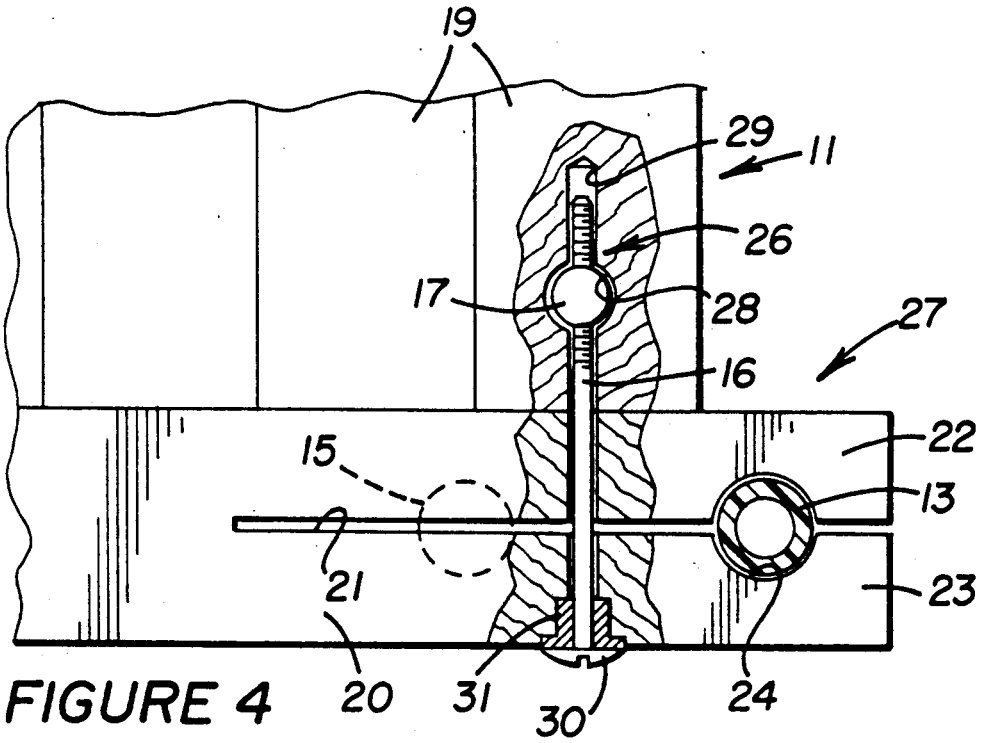
FIG. 4 is a partially sectioned bottom plan view, taken in the direction of arrows IV—IV in FIG. 3.

Referring to FIGS. 3 and 4 a vertically disposed through slot 21 is formed in each end of cross-member 20 to extend from an end of the member, inwardly beyond a respective backrest support 15. The slot is preferably formed by a circular saw as a vertically disposed saw cut, intermediate the width of the cross-member, as shown in FIG. 4. The slot thus defines and separates a pair of cantilevered and opposed integral clamping members 22 and 23. A first receptacle, preferably in the form of a blind cylindrical bore 24, is formed in the underside of crossmember 20 to preferably extend upwardly more than one-half of the thickness of the cross-member (FIG. 3).

Bore 24 bridges across slot 21 and has the upper end of a respective rear leg 13 closely fitted therein prior to clamping. A second blind bore 25 is formed through the upper side of cross-member 20 and is adapted to receive the lower end of a respective backrest support member 15 in closely fitted relationship therein, as also shown in FIG. 3. Bore 25 is spaced inwardly and longitudinally from bore 24 and also bridges slot 21 (FIG. 4). Bore 25 also preferably extends into cross-member 20 at a distance greater than one-half the thickness thereof (FIG. 3).

As shown in FIGS. 1 and 3, legs 12 and 13 and backrest support members 15 may be slightly inclined relative to a vertical plane in accordance with conventional chair design techniques. The legs and support members may each constitute cylindrical tubing composed of a suitable plastic, wooden or metallic structural material providing the desired mechanical and related properties, e.g., flexural, impact, tensile, and shear strengths, etc. For example, the legs and support members may be composed of a standard resin-impregnated fiberglass reinforced pultrusion (FRP) to provide plastic structural members 12, 13 and 15 with the above strength characteristics, as well as a high strength to weight ratio.

Referring again to FIGS. 3 and 4, a fastening means 26, comprising a bolt 16 and nut 17, is disposed transversely relative to slot 21 and between leg 13 and member 15 for drawing clamping members 22 and 23 together. The fastening means forms a clamping arrangement 27 with the clamping members for simultaneously releasably securing the upper end of rear leg 13 and the lower end of backrest support 15 to cross-member 20 and the seat. As further shown in FIGS. 3 and 4, bolt 16 is threadably secured to nut 17 to draw the clamp members 22 and 23 together to at least substantially close slot 21. The outer diameters of leg 13 and backrest support 15, the inside diameter of bores 24 and 25 and the size of slot 21 are suitably dimensioned to impose a firm clamping pressure onto the leg and backrest support.

Standard nut 17 has a cylindrical shape. The nut is inserted into a blind bore 28, formed in the underside of an outboard seating member 19, and has its major longitudinal axis disposed in parallel relationship relative to slot 21 (FIG. 4). The shank end of bolt 16 extends into a bore 29 (FIG. 4), formed transversely relative to slot 21 and bore 28, whereby tightening of the bolt can be effected by Allen wrench !8 (FIG. 2), which is engageable with mating hex slots formed in a conventional manner in head 30 of the bolt. A standard metallic or plastic bushing 31 can be mounted in a counterbore formed on the backside of cross-member 20 to engage head 30 of the bolt, if so desired.

Figure 5:
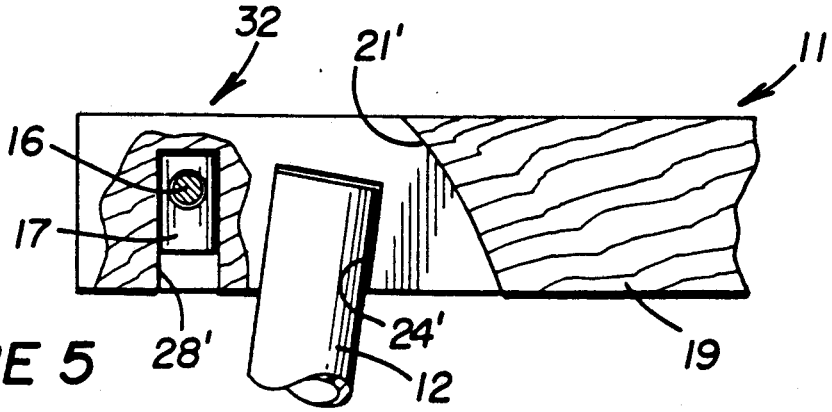
FIG. 5 is an enlarged sectional view, taken in the direction of arrows V—V in FIG. 1 and also further sectioned, illustrating securance of the upper end of a front leg of the chair to the seat thereof.

FIG. 5 illustrates a clamping arrangement 32 similar to clamping arrangement 27 for clamping only the upper end of a respective front leg 12 to an underside and front corner of seat 11. Clamping arrangement 32 also comprises a pair of clamping members formed and separated by a slot 21', a bore 24' bridging the slot to receive the upper end of leg 12 therein, and a bore 28' (FIGS. 2 and 5) formed on the underside of the second inwardly disposed seating member 19 to receive a respective nut 17. A bolt 16, having its head disposed on an outer lateral side of seat 11 (FIG. 1), is adapted to draw the clamping members of clamping arrangement 32 together to secure leg 12 in place. The upper end of each backrest support member 15 may be simply press-fitted and glued into a respective blind bore 33 formed in the lower end of the back rest 14 (FIG. 2) or may be releasably secured to the backrest by a clamping arrangement (not shown) similar to clamping arrangement 32 (FIG. 5).

Figure 6:
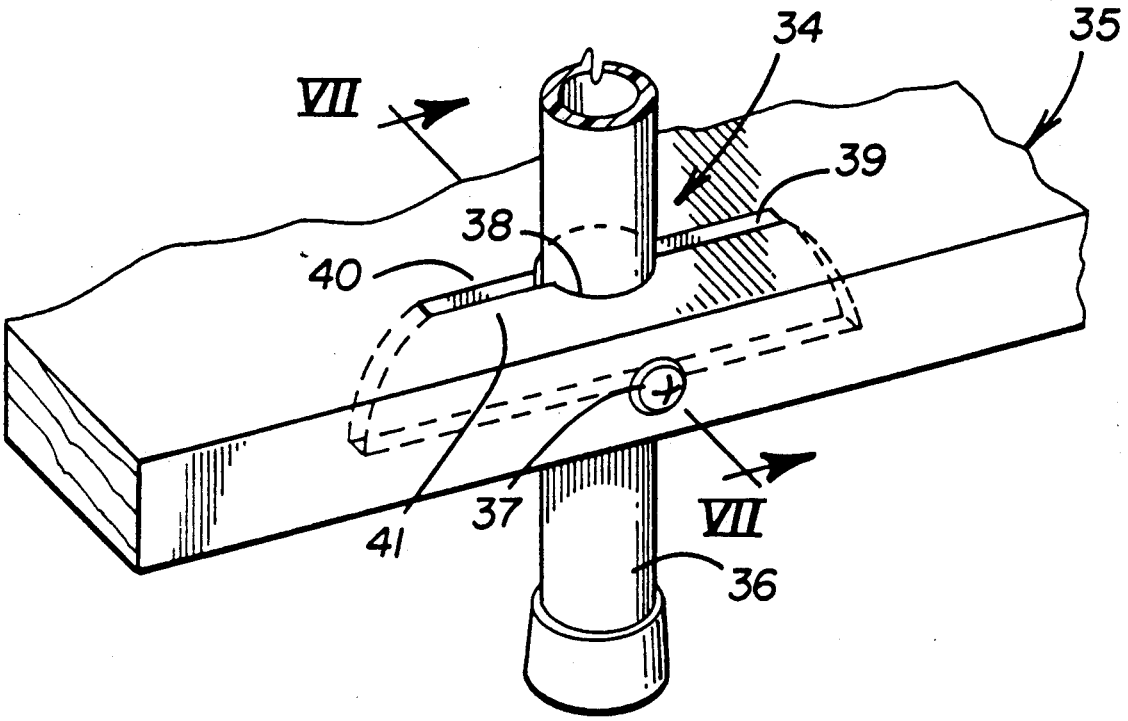
FIG. 6 illustrates another clamping arrangement embodiment of this invention.
Figure 7:
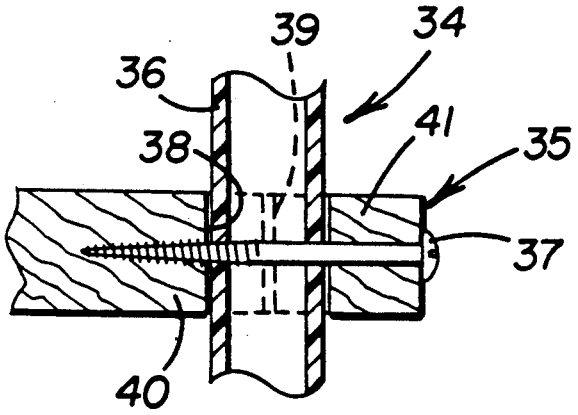
FIG. 7 is a sectional view through the FIG. 6 clamping arrangement, taken in the direction of arrows VII—VII therein.

FIGS. 6 and 7 illustrate a clamping arrangement 34 embodying this invention, particularly adapted for use with shelves and the like. The clamping arrangement comprises a horizontal shelf member 35 having a vertically disposed tubular member 36 releasably attached thereto by a fastener, shown in the form of a standard wood screw 37. A plurality of shelves can be stacked in vertically spaced relationship relative to each other and secured together by a plurality of suitably spaced members 36 and clamping arrangements 34.

Tubular members 36 will thus function as structural support and spacing members for a plurality of shelves. A selected number of the members can be extended below the lowermost shelf (FIG. 6) to further function as legs for the formed bookcase or the like. Each member 36 is initially inserted and closely fitted through a bore 38, formed through a respective shelf member 35. The bore bridges across a closed slot 39, formed by a circular saw cut in shelf member 35 in a manner similar to that described above.

A transverse hole may be pre-drilled into shelf member 35 and through tubular member 36 to accommodate a standard wood screw 40. Slot 39 defines a pair of opposed clamping members 41 and 42 on either side of tubular member 36. Thus, the turning-down of screw 37 will draw the clamping members together, substantially in the manner described above (clamping arrangements 27 and 32), to releasably secure members 35 and 36 together. The members may be composed of the types of materials described above.

The clamping arrangements of this invention can be applied to various types of furniture constructions for the purpose of releasably attaching structural members thereof together. For example, it is contemplated that the teachings of this invention can be applied to furniture assemblies such as chairs, couches, tables, footstools, bookcases and the like. Further, various modifications can be made to the invention without departing from the scope and spirit thereof. For example, members 12, 13 and 36 and their accommodating bores 24, 24' and 38, respectively, could have cross-sections other than circular (e.g., rectangular, hexagonal, etc.). Also, whereas FIG. 4 illustrates a single clamping arrangement 27, it should be understood that multiple and parallel slots 21 and attendant clamping arrangements could be used for securing a plurality of members together in laterally adjacent relationship to each other. Slots 21, 21' and/or 38 could be orientated other that the dispositions shown (e.q., horizontally rather than vertically disposed.

I claim:

1. A modular chair assembly comprising a horizontally disposed and at least generally rectangular seat having frontal and rearward sides to define a pair of laterally spaced font corners and a pair of laterally spaced rear corners, slot means formed at each of the front and rear corners of said seat to define and separate a pair of integral clamping members thereat, a first receptacle formed at each of the front and rear corners of said seat to bridge across a respective one of said slot means, a pair of laterally spaced front legs disposed beneath the front corners at the frontal side of said seat and a pair of laterally spaced rear legs disposed beneath the rear corners of the rearward side of said seat, an upper end of each of said front and rear legs being disposed in a said first receptacle and positioned between a respective pair of said clamping members, fastening means for drawing said clamping members together to releasably clamp and secure the upper end of each respective one of said front and rear legs therebetween, a backrest disposed vertically above the rearward side of said seat, a pair of laterally spaced support members having upper ends thereof secured to said backrest and lower ends thereof secured to said seat, and a pair of laterally spaced second receptacles formed in the rearward, side of said seat adjacent to the rear corners thereof and bridging across the respective slot means, the lower end of each of said support members being disposed in a respective one of said second receptacles and the fastening means securing the upper ends of said rear legs to said seat also simultaneously securing the lower ends of said support members to said seat.

2. The modular chair assembly of claim 1 wherein each said first receptacle comprises a first bore formed to extend to a limited depth into an underside of said seat.

3. The modular chair assembly of claim 2 wherein said first bore extends into said seat a distance that is at least one-half the thickness of said seat.

4. The modular chair assembly of claim 2 wherein each of said second receptacles comprises a second bore formed to extend a limited depth into an upperside of said seat, said second bore bridging across a respective one of said slot means and spaced from a said first bore and a said fastening means being positioned between a respective pair of said first and second bores.

5. The modular chair assembly of claim 1 wherein said fastening means comprises a nut mounted in said seat on a first side of said slot means and a bolt extending into said seat from a second side of said slot means and threadably attached to said nut.

6. The modular chair assembly of claim 5 wherein a bore is formed in an underside of said seat and said nut is mounted in said bore.

7. The modular chair assembly of claim 1 wherein said seat is composed of a plurality of wooden seating members secured together in side-to-side relationship to have their grains extend in a longitudinal direction between the frontal and rearward sides of said seat and a wooden cross-member secured to ends of said seating members at the rearward side of said seat and having its grain extending transversely across said seat between opposite, lateral sides thereof.

8. The modular chair assembly of claim 1 wherein each said slot means is formed as a slot extending to a limited depth in said seat.

* * * * *